United States Patent [19]

Brand

[11] 4,265,598

[45] May 5, 1981

[54] APPARATUS AND METHOD FOR DE-ACTUATING SWIMMING POOL EQUIPMENT

[76] Inventor: Stanley W. Brand, 13102 Woodlawn Ave., Tustin, Calif. 92680

[21] Appl. No.: 942,488

[22] Filed: Sep. 15, 1978

Related U.S. Application Data

[63] Continuation-in-part of Ser. No. 900,511, Apr. 27, 1978, abandoned.

[51] Int. Cl.[3] ..... F04B 49/04; F04H 3/18

[52] U.S. Cl. ..... 417/40; 4/508; 200/84 R

[58] Field of Search ..... 417/40; 4/172.17; 200/84 R

[56] References Cited

U.S. PATENT DOCUMENTS

| | | | |
|---|---|---|---|
| 2,697,196 | 12/1954 | Harper | 417/40 |
| 2,976,807 | 3/1961 | Hill | 417/40 |
| 3,292,547 | 12/1966 | Ward | 417/7 |
| 3,504,145 | 3/1970 | Layher | 200/84 R |
| 3,739,405 | 6/1973 | Schmidt | 4/172.17 |
| 3,809,116 | 5/1974 | Sanner | 4/172.17 |
| 3,902,202 | 9/1975 | Strange | 4/172.17 |

*Primary Examiner*—William L. Freeh

*Attorney, Agent, or Firm*—Knobbe, Martens, Olson, Hubbard & Bear

[57] ABSTRACT

In a swimming pool having an electrically powered pump for circulating water, a portion of the water in the swimming pool is directed into a chamber in communication with the pool, so that the level of the water in the chamber is the same as the level of the water in the pool. The circuit supplying electrical current to the pump includes a switch mounted in the chamber. A float supported by the water in the chamber is mechanically connected to the switch in such manner that the switch permits current to flow to the pump, when the float is supported at or above a predetermined level. A drop in the level of water in the pool causes a corresponding drop in the level of water in the chamber, so that the float falls and actuates the switch causing the pump to be disconnected from its power supply.

1 Claim, 8 Drawing Figures

APPARATUS AND METHOD FOR DE-ACTUATING SWIMMING POOL EQUIPMENT

RELATED APPLICATIONS

This application is a continuation-in-part of application Ser. No. 900,511 filed Apr. 27, 1978 entitled APPARATUS AND METHOD FOR DE-ACTUATING SWIMMING POOL EQUIPMENT, now abandoned, by Stanley William Brand, the applicant of this continuation-in-part application.

BACKGROUND OF THE INVENTION

The invention relates to a system for automatically de-actuating electrical swimming pool pumps and other electrical equipment associated with the operation of a swimming pool. More specifically, the invention relates to a method and apparatus for shutting down such equipment in response to a predetermined drop in the level of water in the swimming pool.

Modern swimming pools typically include a filtration system for cleansing the water of dirt, algae and other undesirable matter such as hair, grass, etc. Such filtration systems normally incorporate an electrically-powered pump which pumps the water from the pool through a diatomaceous earth or sand filter and then back into the pool. It is usually necessary to circulate the water in the pool in this manner for a certain period of time each day (the amount of time depending on such factors as the size of the pool, the temperature of the water and the amount of usage of the pool, among others) in order to prevent the accumulation of a layer of dust and dirt on the surface of the water and to inhibit the growth of algae. To this end, it is quite common to have the swimming pool pump turned on for a predetermined period each day by means of a timer-clock switch. Such a system has the advantage that the pool may be left unattended for a period of several days or weeks without fear that the pool will accumulate excessive amounts of dirt and algae. Thus, such systems are particularly advantageous in swimming pools located in the yards of single family residences where the owners may be away for extended periods on vacations and the like.

This automatic cycling of the circulation system on and off does, however, present a potential hazard. For example, should leak occur in the water conduits between the pump and the swimming pool on the outlet side of the pump, while the pool is left unattended, vast quantities of water may be drained from the pool through the leak when the pump cycles on automatically. Not only can this result in substantial damage to the area which is flooded by the water emanating from the leak, but also there is the chance that if the situation is allowed to persist, the pool may be pumped completely dry, thereby necessitating not only the troublesome operation of refilling the pool, but also subjecting the pool to the danger of cracks, requiring considerable expense to repair. Moreover, the timer-clock which cycles the pump on and off frequently performs the same function for the swimming pool underwater lights. These lights must be kept underwater at all times that they are in operation, inasmuch as contact with the water is required to prevent the lamps from overheating. Thus, a leak in the circulation system which caused the level of the water water in the pool to drop below the lamps could result in their destruction. Furthermore, if the leak results in the drainage of the pool, there would be no water flowing into the pump, which could result in substantial damage to the pump if it is allowed to run for any significant length of time in this condition.

It will readily be appreciated at this point that the above problems can occur not only in a swimming pool circulation system, but also with any system having a reservoir of liquid which is circulated by means of an electrical pump. Thus, the need has been established in such systems for means of de-actuating, in response to a predetermined drop in the level of liquid in the pool or reservoir, the pump or other electrical apparatus which may cause or suffer damage if the level of liquid drops below a predetermined level.

SUMMARY OF THE INVENTION

The present invention utilizes a device known as a float switch, which can be readily purchased from an electrical supply store. The float switch comprises, basically, a two position switch which is actuated by a float in such a way that the switch is in one state, either on or off, when the float is above a preset level. When the float falls below this predetermined level, it trips the switch, by means of a mechanical linkage, to the opposite state.

The thrust of this invention is in the novel utilization of this float switch. The switch is incorporated in the electrical circuit supplying power to a swimming pool pump, lamps, and/or other electrical apparatus associated with the operation of a swimming pool, in such a manner that when the switch is closed, the electrical apparatus is electrically coupled to the power source, and when the switch is open, the electrical apparatus is disconnected from the power source.

The switch is mounted in a hollow tube or chamber which communicates with the pool, so that water from the pool fills the chamber to a level which is the same as the level of the water in the pool. The float of the float switch floats on the surface of the water in the chamber, and, if the pool is filled to its normal level, the bouyant action of the float will cause the switch to complete the circuit between the power source and the electrical apparatus. As the water level in the pool drops, there will be a corresponding drop in the level of the water in the chamber, causing the float to descend therewith. When the float has descended to a predetermined level (which can be adjusted) the float will cause the switch to open the circuit between the apparatus and the power supply.

Electrical apparatus such as swimming pool pumps are usually run on a voltage of approximately 220 to 240 volts. Inasmuch as the float switch is situated in proximity to the water in the chamber which in turn communicates with the water in the swimming pool, it is desirable, for reasons of safety, to have the float switch wired into a relatively low voltage circuit, preferably on the order of about 12 volts. The float switch is then connected to a relay in the high voltage power supply circuit so that the float switch causes the relay to complete the circuit between the power supply and the swimming pool apparatus when the level of water is above the predetermined level, and to break the circuit between the power supply and the apparatus when the level of water is below the predetermined level.

The present invention is most advantageously constructed so as to be installed at the same time as the swimming pool, but it may also be constructed so as to be conveniently added on to an existing pool. Embodiments illustrating both manners of installation are described hereinafter.

DETAILED DESCRIPTION OF THE INVENTION

Figure 1:
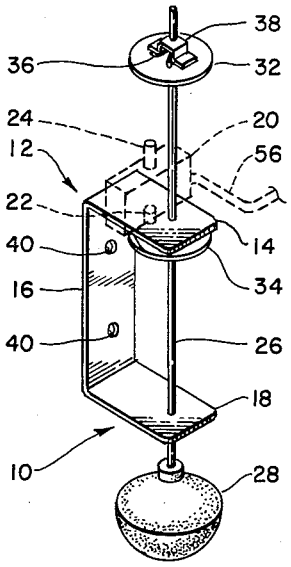
FIG. 1 is a perspective view of a float switch used in the present invention.

In order to obtain a complete understanding of the functioning of the invention, it is helpful to begin with a description of the active element of the device, which is a float switch 10 best illustrated in FIG. 1. The float switch 10 consists of a three-sided right angle bracket 12, having an upper horizontal portion 14, a vertical portion 16 extending downwardly therefrom, and a lower horizontal portion 18 extending from the vertical portion 16 so as to underlie directly the upper horizontal portion 14. Rigidly mounted on the top surface of the upper horizontal portion 14 of the bracket 12 is a switch element box 20 which contains a single pole, single throw switch (not shown). The switch is closed by depressing an "on" button 22 which extends downwardly from the switch element box 20 through a registering aperture (not shown) in the upper horizontal portion 14 of the bracket 12. The switch is opened by depressing an "off" button 24 which extends upwardly from the switch element box 20.

Extending through a pair of aligned apertures in the upper horizontal portion 14 and the lower horizontal portion 18 respectively of the bracket 12 is a rigid linkage rod 26. The rod is freely movable vertically and extends a substantial distance above and below the bracket 12. Attached to the lower end of the rod 26 is a hollow float element 28. Carried on the opposite end of the linkage rod 26 from the float element 28 is a circular "off" button actuator plate 32. A similar "on" button actuator plate 34 is carried on the middle portion of the linkage rod 26. The linkage rod 26 passes through apertures in the centers of the actuator plates 32 and 34 and is connected to them by means of spring clips 36, which are maintained in contact with the linkage rod and the actuator plates by means of brackets 38 mounted on the actuator plates 32 and 34. The brackets are suitably apertured so that the linkage rod 26 passes through them. The use of the spring clips 36 to fasten the actuator plates 32 and 34 to the linkage rod 26 allows the vertical position of the actuator plates 32 and 34 relative to the linkage rod 26 to be adjusted for the purposes to be described hereinafter.

The vertical portion 16 of bracket 12 is provided with a pair of holes 40 so that the float switch assembly 10 may be attached to the interior wall of a tubular inner housing 42 by means of rivets 44 passing through the holes 40 and into the wall of the inner housing 42. Of course, other means for attaching the bracket 12 to the wall of the inner housing 42 may be employed, such as screws or a permanent water insoluble adhesive.

The tubular inner housing 42 may be formed of a length of conduit made of a durable insulating material, such as polyvinylchloride. The inner housing 42 is contained within the upper portion of a vertically disposed tubular conduit 46 with the exterior surface of the inner housing 42 being in a snug, yet slideable fit against the interior surface of the outer conduit 46. Like the inner housing 42, the outer conduit 46 may be conveniently formed from a suitable length of tubular pipe material, preferably polyvinylchloride or a like material.

The upper periphery of the inner housing 42 is flush with the upper periphery of the outer conduit 46. The inner housing 42 and the outer conduit 46 are attached to each other by means of one or more screws 48 extending inwardly from the exterior surface of the outer conduit 46 and into the inner housing 42, a short distance below the upper termination of the inner housing 42 and the outer conduit 46. The screws 48 may be removed so that the inner housing 42 and the switch assembly attached to it may be removed as a unit for the purposes of inspection, maintenance, and repair.

The upper periphery of the inner housing 42 is provided with a pair of diametrically opposed, inwardly extending ears 50. The upright chamber formed by the inner housing 42 and the outer conduit 46 is sealed at the top by a circular cap 52, the lower surface of which rests against the upper surface of the ears 50, with the latter providing seats for a pair of screws 54 passing through the cap 52 and attaching it to the upper end of the chamber. Thus, by removing the screws 54, the cap 52 can be removed, allowing visual inspection of the float switch assembly.

Figure 4:
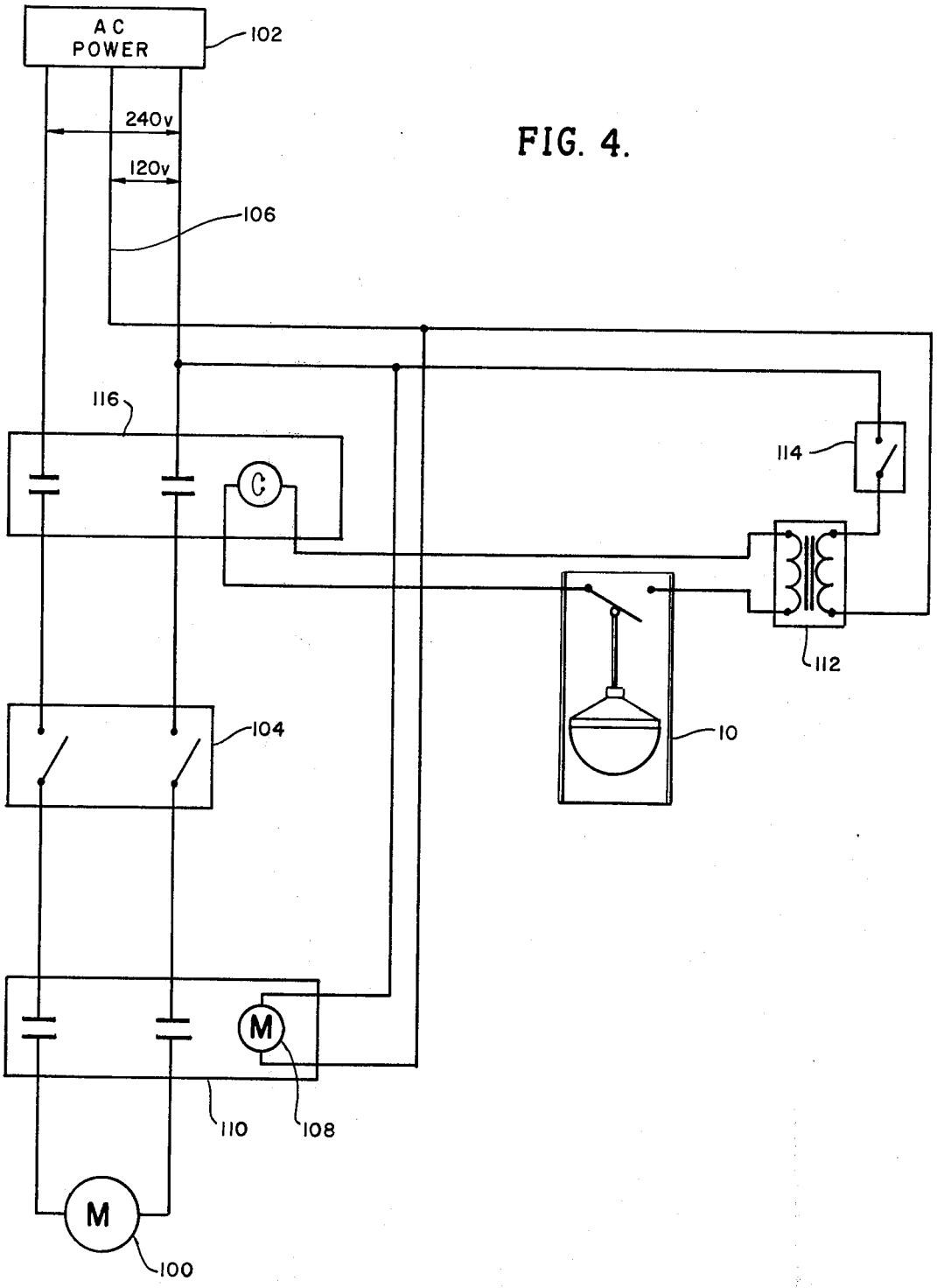
FIG. 4 is a schematic diagram of the electrical circuit employed by the first and second embodiments of the present invention.

Extending into the switch element box 20 is a thin, insulated cable 56 containing the wires (not shown) which electrically connect the switch into the circuit shown in FIG. 4. The other end of the cable 56 terminates in a plug 58 which removably mates with a plug receptacle 60 spaced from the interior wall of the inner housing 42. The use of the plug 58 and the plug receptacle 60 allows the switch assembly 10 to be quickly disconnected when it is desired to remove the switch assembly as previously described. Extending downwardly from and rigidly supporting the plug receptacle 60 proximate the interior wall of the inner housing 42 is a narrow rigid tubular conduit 62 made of a suitable insulating material. The lower end of the vertical conduit 62 terminates in the vertical arm of an elbow 63, the horizontal arm of which extends outwardly through an aperture in the wall of the inner housing 42 and the outer conduit 46. Into the horizontal arm of the elbow 64 is fitted a horizontal conduit 66, similar in all respects to the vertical conduit 62, and which extends to an area remote from the pool in which are located the remaining components of the circuitry shown in FIG. 4. The plug receptacle 60 is electrically connected to these components by means of wires (not shown) running through the conduits 62 and 66 and the elbow 64. The inner housing 42 is suitably slotted axially from its lower periphery to accomodate the elbow 64, so that the inner housing may be slidably removed as previously described.

Figure 2:
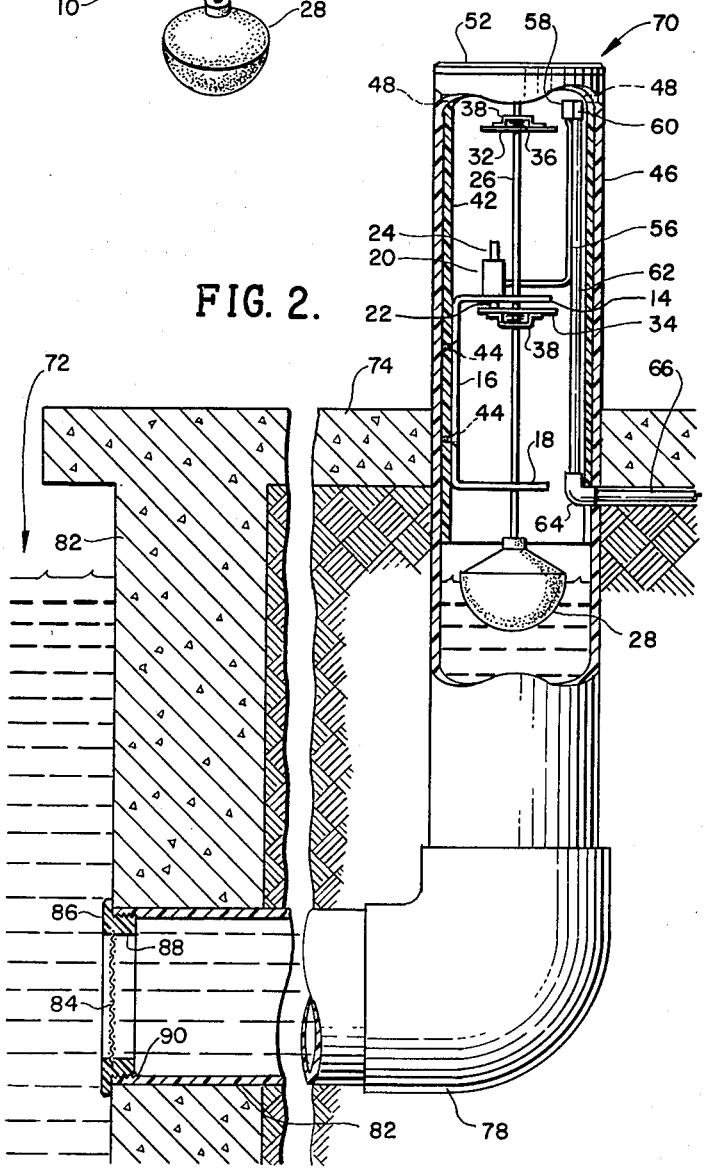
FIG. 2 is a side elevation view, partially in section, of a first embodiment of the present invention and showing its installation with a contemporaneously constructed swimming pool.

The inner housing 42, the outer conduit 46, and the sealing cap 52, along with the components contained therein, form what may be called a water level monitoring chamber, designated generally by the numeral 70. FIG. 2 shows the preferred manner of installation of the water level monitoring chamber 70 in relation to a swimming pool 72, whose water level is to be monitored. The installation illustrated in FIG. 2 is particularly well-suited for situations where the water level monitoring chamber is installed contemporaneously with the swimming pool. As shown in FIG. 2, the swimming pool 72 has a deck 74, which is laid over the surface of the earth around the perimeter of the pool. The outer conduit 46 is installed so as to extend through the deck 74 near the outer periphery of the deck and into the earth a substantial distance below the deck. The lower end of the outer conduit 46 terminates in the vertical arm of an elbow 78. A horizontal conduit 80 extends from the interior of the pool through a wall 82 of the pool and through the earth underlying the deck 74 and into the horizontal arm of the elbow 78. With this construction, water will flow from the pool into the conduit 82, through the elbow 78, and up into the chamber 70, filling the chamber to a level equal to the level of the water in the pool. In order to ensure that water is present in the chamber 70 whenever the level of water in the pool is above the minimum desired level, it is necessary that the horizontal conduit 82 enter the pool below the minimum desired level of water. At its entrance into the pool, the horizontal conduit 82 is advantageously terminated by a circular filter screen 84, the perimeter of which is attached to the interior walls of an annular flange 86. The flange 86 is removably attached to the conduit 82 by means of an annular boss 88 which extends a short way into the conduit 82 and which has a threaded outer surface 90, which mates with a similarly threaded portion of the interior wall of the conduit 82. The filter screen 84 serves to prevent debris from entering the chamber 70, where it may interfere with the action of the float switch assembly 10. Since the screen 84 is attached to the removable flange 86, the screen may be easily removed for cleaning.

Figure 3:
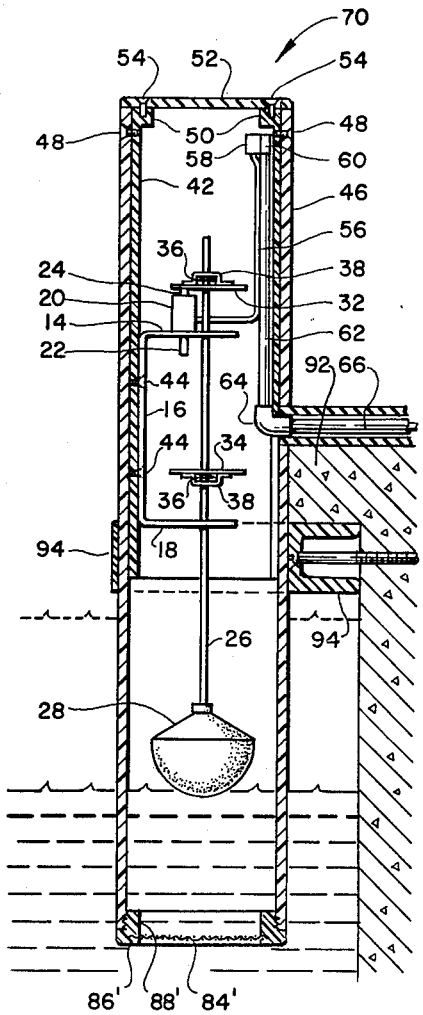
FIG. 3 is a side elevation view, partially in section, of a second embodiment of the invention and showing its installation as an attachment to a pre-existing swimming pool.

FIG. 3 shows an alternative installation of the water level monitoring chamber 70, which is advantageous when it is desired to incorporate the invention into an already existing pool. In this installation, the lower portion of the outer conduit 46 is attached to the edge of a pool coping 92 by means of conventional circular bracket 94. The conduit 46 extends into the pool to a level below the minimum level of water desired in the pool. Like the horizontal conduit 82 in FIG. 2 and for similar reasons, the lower end of the vertical outer conduit 46 is terminated by a filter screen 84' contained within an annular flange 86', which is attached to the conduit 46 by means of a threaded annular boss 88'. In this installation, the level of water in the chamber 70 will naturally be equal to the level of water in the pool.

FIG. 4 illustrates in schematic form the electrical circuitry associated with the present invention. A pool pump motor 100 is powered by a 240 volt AC power supply 102. A double pole, single throw master switch 104 is wired into the circuit between the power supply 102 and the motor 100, so that the motor may be manually switched off at any time. The power supply 102 is center tapped by 120 volt line 106, which supplies the power for a 120 volt time clock motor 108, which in turn runs a double pole time clock switch 110 in the power supply circuit for the pool pump motor 100. The time clock switch 110 allows the pump motor 100 to be turned on and off automatically at selected times of the day.

The 120 volt line 106 also energizes the primary coil of a step-down transformer 112 through a 20 amp circuit breaker 114 as a safety precaution. The transformer 112 steps the voltage down from 120 volts to 12 volts in the secondary coil, the latter being connected to the coil of a normally open, double pole, 12 volt relay 116, which is wired into the pool pump power supply circuit between the power supply 102 and the pool pump 100. The float switch 10 is connected in series between the secondary coil of the transformer 112 and the coil of the relay 116, so that the relay 116 will be energized and therefore closed when the float switch 10 is closed and the relay 116 will be open when the float switch 10 is open. Thus, if the master switch 104 is closed and the time clock switch 110 is closed, closing the float switch 10 will close the relay 116, thereby allowing current to flow from the power source 102 to the pump motor 100.

Of course, the float switch may be wired directly in series between the power supply 102 and the motor 100, thereby eliminating the need for the transformer 112 and the relay 116. However, since the float switch 10 is in close proximity to the water in the swimming pool, it is desirable for safety reasons to have the voltage in the float switch circuit be as low as possible. The use of the transformer 112 and the relay 116 allows the voltage in the float switch circuit to be as low as 12 volts, which is considered to be a safe level. Alternatively, the relay 116 may be energized, through the float switch 10, by a separate low voltage power supply, such as a battery.

The operation of the invention is illustrated in FIGS. 2 and 3. In FIG. 2 the water in the pool is at or above the minimum desired level. The level of the water in the water level monitoring chamber 70 is at the same level as the water in the pool. The float element 28 floats on the surface of the water in the chamber 70 and is at a level which is high enough to ensure that the "on" button actuator plate 34, to which the float 28 is connected by means of the linkage rod 26, is pressed against the "on" button 22, so that the "on" button is depressed, thereby closing the switch contacts in the switch element box 20. Thus, the float switch 10, as shown in FIG. 4, will be closed, thereby energizing the relay 116 so that the pump motor 100 may be energized by the power source 102.

In FIG. 3 the water level in the pool has dropped to the minimum desired level. The level of water in the water level monitoring chamber 70 is naturally the same as the level in the pool. Accordingly, the float member 28 has dropped, pulling the linkage bar 26 with it, so that the "on" button actuator plate 34 has dropped out of contact with the "on" button 22 and the "off" button actuator plate 32 has been brought to bear upon the "off" button 24, so that the switch in the switch element box 20 is opened. As shown in FIG. 4 with the float switch 10 open, the relay 116 is de-energized and reverts to its normally open position, thereby breaking the circuit between the power supply 102 and the pump motor 100.

As previously mentioned, the vertical positions of the actuator plates 32 and 34 on the linkage rod 26 may be adjusted by means of the spring clips 36. As may be readily appreciated from FIG. 2 and FIG. 3, raising or lowering the "off" button actuator plate 32 will lower or raise, respectively, the level of water in the pool which will open the float switch 10. Similarly, raising or lowering the "on" button actuator plate 34 will raise or lower, respectively, the level of water in the pool which will cause the float switch 10 to be closed. In this manner, the float switch 10 can be adjusted to accommodate different minimum desired levels of water in the pool.

In both of the above-described manner of installation, the chamber 70 serves to isolate the float switch assembly 10 from accidental contact by people in and around the pool, while at the same time serving to minimize the effects of wave action in the pool on the switch, which could result in an intermittent actuation and de-actuation of the pump.

Figure 5:
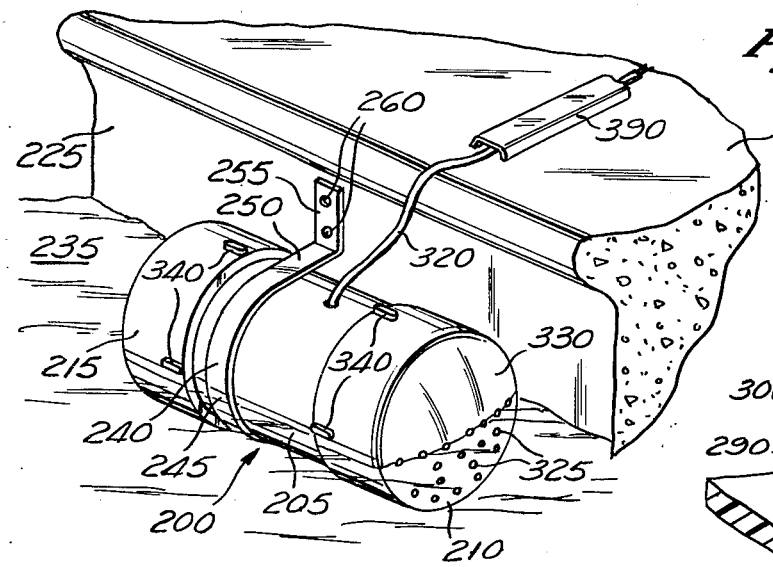
FIG. 5 is a perspective view of the preferred embodiment of this invention installed in a swimming pool.
Figure 6:
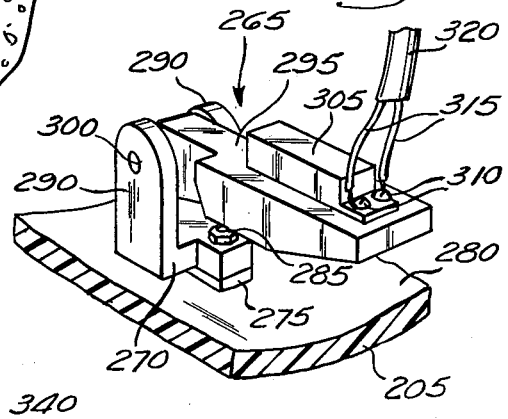
FIG. 6 is a cut-away perspective view of the preferred embodiment of FIG. 5 showing the float switch mechanism of FIG. 6.
Figure 7:
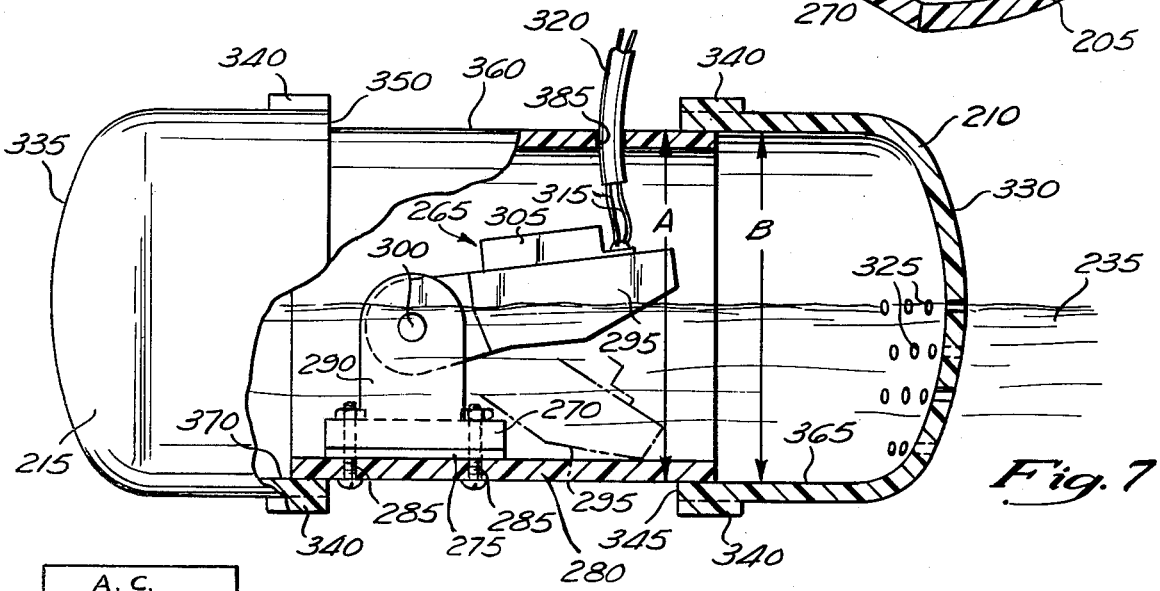
FIG. 7 is a partially cut-away elevational view of the embodiment of FIG. 5 showing the operation of the float switch mechanism of FIG. 6.

FIGS. 5, 6 and 7 show the preferred embodiment of the invention. A de-actuating apparatus 200 comprises a horizontally disposed tubular housing 205 and two end caps 210 and 215. The tubular housing 205 and the caps 210, 215 are preferably formed of a rigid insulating material such as polyvinylchloride. As illustrated in FIG. 5, the tubular housing 205 is removably mounted on a pool sidewall 225 adjacent a pool deck 230 and at approximately the optimum level of pool water 235 by means of a bracket 240. The bracket 240 comprises an arcuate portion 245 snugly fitting around the circumference of the tubular housing 205, and a flat portion 250 connected to an upright portion 255. The upright portion 255 is fastened to the pool sidewall 225 by means of suitable fastening means, such as screw fasteners 260. The tubular housing 205, and the end caps 210, 215 form a chamber which houses a float switch 265 as illustrated in FIG. 6. The float switch 265 comprises a base 270 fastened over a shim 275 onto the bottom portion 280 of the tubular housing 205 by suitable fastening means such as fastening nut and screw assemblies 285. Integral with the base 270 and extending upwardly therefrom are a pair of legs 290, which pivotally support a floating pivot arm 295 by means of a pivot pin 300 which passes through both the floating arm 295 and the pair of legs 290. The floating arm 295 is buoyant and may be made of a material which has a density less than that of water, or it may be hollow and air-filled. The floating arm 295 supports a mercury switch 305 mounted on the top face of the floating arm 295. The mercury switch has a pair of switch terminals 310 with wires 315 attached thereto forming a cable 320. The mercury switch 305 is preferably mounted on the floating arm 295 so as to be open or off whenever the floating arm is poised upward with respect to the bottom portion 280 of the tubular housing 205, and to be closed or on whenever the floating arm 295 has dropped downwardly toward the bottom portion 280 of the tubular housing 205. The chamber formed by the tubular housing 205 and the end caps 210, 215 protect the float switch from waves in the water 235 caused by turbulence in the water 235. Such turbulence would otherwise cause the floating arm 295 to be raised or lowered sporadically, thereby upsetting the operation of float switch 265. Water is permitted to enter into this chamber by means of vent holes 325 formed in the end cap 210. The vent holes 325 are preferably formed in only the one end cap 210 of the apparatus 200 so as to prevent the deleterious action of water waves on the operation of the float switch 265.

The end caps 210, 215 are formed of a durable, rigid insulating material such as polyvinylchloride, and each has a partially hemispherical endface 330, 335 respectively. The vent holes 325 are formed in the end cap 210 through the endface 330. Each of the end caps 210, 215 is provided with a plurality of gripping nodes 340 on the edge circumference 345, 350 of the end caps 210, 215 respectively. The gripping nodes 340 facilitate easy handling and removal of the end caps 210, 215. The end caps 210, 215 are preferably held onto the tubular housing 205 by means of a friction fit to facilitate easy access to the switching mechanism. Thus, as shown in FIG. 7, the outside diameter A of the tubular housing 205 must be just slightly less than the inside diameter B of the end caps 210, 215 in order to provide a tight fit between the outer surface 360 of the tubular housing 205 and the inner surface 365, 370 of the end caps 210, 215 respectively.

Figure 8:
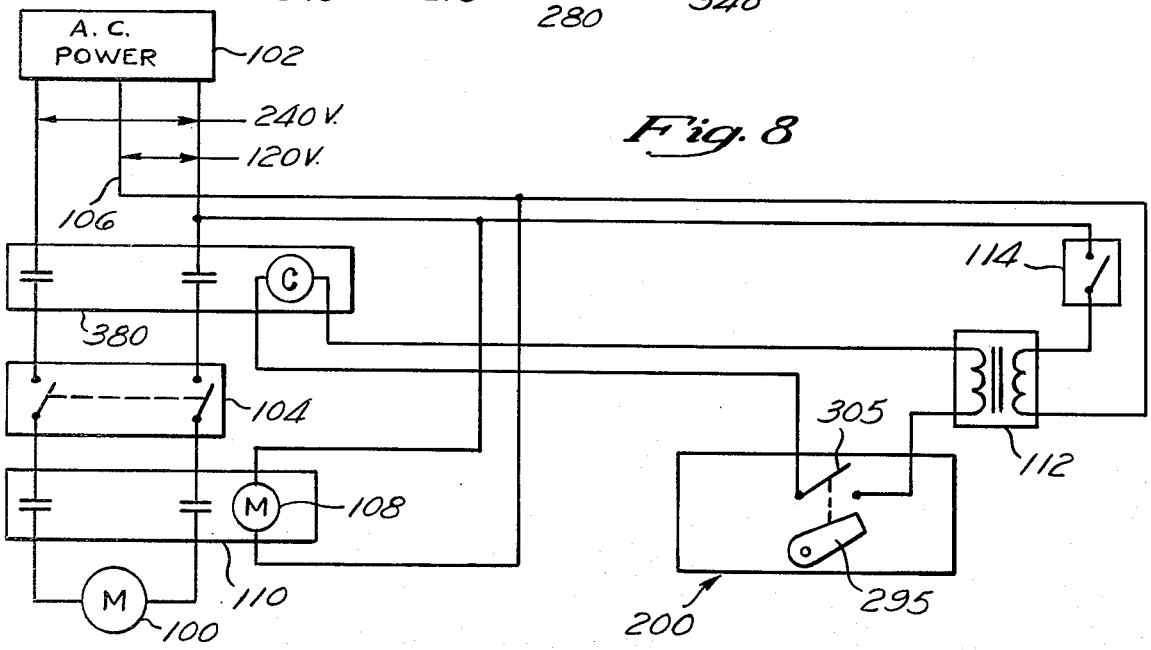
FIG. 8 is a schematic diagram of the electrical circuit employed in the preferred embodiment of this invention illustrated in FIGS. 5, 6 and 7.

As shown in FIG. 8, the mercury switch 305 interrupts the circuit between the step down transformer 112 and a normally closed, double pole 12 volt relay 380. For this purpose, the two wires 315 in the cable 320 attached to the switch terminals 310 as shown in FIG. 6 pass through a cable passage 385 formed in the top of the tubular housing 205. For protection, a cable cover 390 as shown in FIG. 5, may be installed on the cable 320 over the pool deck 230.

The circuit of the schematic diagram of FIG. 8 is similar to the circuit of the schematic diagram of FIG. 4, with the very important exception that the dual relay 380 is a normally closed relay and is opened only when energized by the closing of the switch 305. It will be recalled that the relay 116 of FIG. 4 is a normally opened relay, and is closed only when the floating switch 10 of FIG. 4 is closed. The circuit of the schematic diagram of FIG. 8 has the advantage that the relay is normally not energized as long as the level of pool water maintains the floating switch 295 in an upward position as illustrated in FIGS. 7 and 8.

Referring to FIG. 7, the position of the floating arm 295 shown in solid lines corresponds to the buoyant floatation of the floating arm 295 by the presence of the pool water 235 inside the chamber formed by the inner housing 205 and the end caps 210, 215. However, when the level of water in the chamber substantially drops in response to a corresponding drop in the level of pool water 235, the floating arm is not buoyantly supported by water 235, and therefore pivotally falls about the axis defined by the pin 300 until it reaches the position shown in phantom lines in FIG. 7. In the solid line position of FIG. 7, the mercury switch 305 is open or off. When the float arm 295 is in the phantom line position illustrated in FIG. 7, the mercury switch is closed or on. This operation is schematically illustrated in the diagram of FIG. 8 showing a dashed connecting line between the mercury switch 305 and the floating arm 295. It is contemplated that the pool water will maintain the floating arm in its upright solid line position as illustrated in FIG. 7 during normal operation. Only when the pool suffers an abnormal loss of pool water, will the floating arm 295 be in its downward or phantom line position as shown in FIG. 7. Thus, it is seen that the relay 380 is unenergized through the floating switch 265 under normal operation. Therefore, it is only under infrequent circumstances that extra current would have to be supplied through the transformer 112 and the floating switch 265 to energize the relay 380. This results in improved life cycle and less wear in the relay 380 and the transformer 112.

It has been seen that the installation of the device illustrated in FIGS. 5 through 8 will result in a deactivation of the motor 100 whenever the pool water falls below a certain predetermined level. This predetermined level is a function of the location of the floating arm 295 and the mercury switch 305 relative to the top of the pool sidewall 225. This predetermined level may be adjusted by either changing the height at which the bracket 240 is mounted on the pool sidewall 225, or by replacing the shim 275 with a shim of a different thickness.

The modular design of the de-actuating apparatus 200 of FIG. 5 permits the apparatus 200 to be installed in any pool either before or after the pool is built and filled with water. Therefore, this invention finds use for all persons including pool owners whose pools are already in use.

The operation of the deactivating apparatus 200 of FIGS. 5, 6, 7 and 8 begins with the pool water 235 being above the predetermined level such that the float arm 295 is in the upright position illustrated in the solid line position of the float arm 295 of FIG. 7. In this position, as illustrated in FIG. 8, the switch 305 is open and therefore no current flows between the transformer 112 and the relay 380. Because the relay 380 is normally closed, the relay allows current to flow from the AC power source 102 to the pump 100. However, if pool water should somehow be lost from the pool, the level of the pool water 235 would fall below the level of the apparatus 200 thereby causing the floating arm 295 to fall to its downward or phantom line position illustrated in FIG. 7. In this position, the mercury switch 305 is closed, and current therefrom flows between the transformer 112 and the relay 380, thereby energizing the relay coils within the relay 380. This causes the relay 380, which is normally closed, to be opened, thereby prevent any current from flowing between the AC power source 102 and the pump 100.

It can readily be appreciated that the invention is not limited to use in conjunction with a swimming pool pump motor. Other electrical apparatus such as swimming pool flood lights or a swimming pool heater can be actuated and de-actuated in response to the level of water in the swimming pool by means of the invention in a similar fashion. In addition, the invention can be readily adapted for any application where it is desired to actuate or de-actuate electrical equipment in response to a change in the level of a liquid in a reservoir. For example, where it is desired to keep a minimum level of liquid in a reservoir, the invention may be used to actuate a pump when the level in the reservoir falls below the minimum and de-actuate the pump when the desired level is once again reached. Similarly, several float switches used in accordance with the present invention may be used in conjunction with a liquid filled reservoir to actuate and de-actuate different electrical apparatus in response to different levels of liquid in the reservoir. Such applications will be readily apparent to those skilled in the pertinent arts and should be considered within the scope of the present invention.

I claim:

1. A device for automatically deactuating an electrically powered water pump for a swimming pool in response to a predetermined drop in the level of water in the pool, comprising:

an open-ended tubular member horizontally disposed in said pool;

first and second cap members covering the open ends of said tubular member and removably attached thereto;

said tubular member with said cap members forming a chamber in communication with said pool filled with water from said pool to the same level as the water in said pool, at least one of said cap members having means for permitting the flow of water from said pool into and out of said chamber;

electrical switching means for electrically coupling said pump to an electrical power source when said switching means is in a first state and decoupling said pump when said switching means is in a second state;

float means floating in the water in said chamber and connected to said switching means for maintaining said switching means in said first state when said float means is supported by the water in said chamber at least at a predetermined level, and changing said switching means to said second state when said float means falls below said predetermined level in response to a corresponding drop in the level of water in said pool.

* * * * *